US006178307B1

(12) United States Patent
Kimura

(10) Patent No.: US 6,178,307 B1
(45) Date of Patent: Jan. 23, 2001

(54) ATTRACTION MEMBER AND IMAGE FORMING APPARATUS USING THE SAME

(75) Inventor: Yoichi Kimura, Numazu (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/419,090

(22) Filed: Oct. 15, 1999

(30) Foreign Application Priority Data

Oct. 21, 1998 (JP) ..... 10-318391
Sep. 13, 1999 (JP) ..... 11-258922

(51) Int. Cl.[7] ..... G03G 15/00; G03G 15/16
(52) U.S. Cl. ..... 399/303; 399/299; 399/390
(58) Field of Search ..... 399/45, 66, 296, 399/299, 303, 388, 390; 492/18, 20; 361/214, 221

(56) References Cited

U.S. PATENT DOCUMENTS 5,602,633 * 2/1997 Yoshida et al. ..... 399/299
5,845,188 * 12/1998 Fujii et al. ..... 399/390
5,873,016 * 2/1999 Kurokawa et al. ..... 399/299 X
5,923,938 * 7/1999 Enomoto et al. ..... 399/303
6,029,022 * 2/2000 Takase ..... 399/66

FOREIGN PATENT DOCUMENTS 2-157779 6/1990 (JP) .

* cited by examiner

*Primary Examiner*—Sophia S. Chen
(74) *Attorney, Agent, or Firm*—Fitzpatrick, Cella, Harper & Scinto

(57) ABSTRACT

An image forming apparatus can form a high-quality image by preventing a failure in image transfer by preventing separation of a part of a recording material electrostatically attracted on a recording-material carrying member from the recording-material carrying member. An attracting charger is made of a rigid conductive rubber in a region at a central portion. A nonrigid conductive fur brush is planted on each of regions at both end portions of the attracting charger. Thus, a pressing force applied to the recording material differs in a direction substantially orthogonal to a direction of conveying the recording material.

38 Claims, 7 Drawing Sheets

ATTRACTION MEMBER AND IMAGE FORMING APPARATUS USING THE SAME

BACKGROUND OF THE INVENTION

1. Field of the Invention

The present invention relates to an image forming apparatus, such as a copier, a printer, a facsimile apparatus or the like, which transfers an image on an image bearing member onto a recording material carried on a recording-material carrying member.

2. Description of the Related Art

Image forming apparatuses have been produced in which image formation is performed by conveying a recording material, such as paper or the like, in a state of being attracted on an endless belt (a recording-material carrying member), and transferring a visual image formed on an image bearing member onto the recording material at a transfer portion.

An example of such image forming apparatuses will be briefly described with reference to FIG. 7.

In FIG. 7, within a main body of an image forming apparatus 100, a photosensitive drum 105 is disposed at a central portion. A pre-exposure lamp 101, a photosensitive drum charger 102, an exposure apparatus 103, a developing unit 104, a transfer charger 107 and a cleaner 108 are provided around an outer circumference of the photosensitive drum 105.

A recording-material carrying member (hereinafter termed a "transfer belt") 106 is provided near the photosensitive drum 105. A toner image formed on the photosensitive drum 105 is transferred onto a recording material P carried and conveyed on the transfer belt 106.

The toner image on the recording material P is fixed by a fixing unit 109 by means of heat and pressure, and the recording material P having the toner image transferred thereto is discharged to the outside of the apparatus as a recorded image.

In the exposure apparatus 103, a laser beam emitted from a light source (not shown) provided at an upper portion of the main body of the apparatus is converted into a scanning beam by a rotating polygonal mirror. The scanning beam is reflected by a reflecting mirror and is condensed onto the generatrix of the photosensitive drum 105 by an fθ lens to expose the photosensitive drum 105. Thus, a latent image corresponding to an image signal is formed on the photosensitive drum 105.

A predetermined amount of toner is filled in the developing unit 104 from a toner supply device (not shown). The latent image on the photosensitive drum 105 is developed by the toner, to provide a visualized toner image.

The recording material P is supplied from a recording-material cassette (not shown) or a manual-insertion sheet feeding tray 117 to the transfer belt 106 via a plurality of conveying rollers and a pair of registration rollers 113, and is further fed to a transfer portion facing the photosensitive drum 105 by being conveyed by the transfer belt 106.

The transfer belt 106 is made of a material obtained by dispersing a conductive filler, such as carbon black or the like, in a sheet of a dielectric resin, such as a polycarbonate resin, a polyethylene terephthalate (PET) resin, a polyvinylidene fluoride resin, a polyurethane resin, a polyamide resin, a polyimide resin or the like, in order to reduce the volume resistivity of the insulating resin to about $10^7$–$10^{11}$ Ω·cm, and has an endless shape by superposing and bonding both end portions of the sheet, or the shape of a seamless belt.

When the transfer belt 106 is rotated by a driving roller 111 in conjunction with an idler roller 112 and reaches a constant speed, the recording material P is fed from the pair of registration rollers 113 to the transfer belt 106, and is conveyed to the transfer portion. At the same time, an image write signal is generated, and image formation is performed on the photosensitive drum 105 at a certain timing based on the signal.

By providing an electric field or electric charges from the transfer charger 107 at the transfer portion below the photosensitive drum 105, the toner image formed on the photosensitive drum 105 is transferred onto the recording material P. When the recording material P is fed from the pair of registration rollers 113 onto the transfer belt 106, the recording material P is immediately grasped by an attracting charger 114 and a roller 115 facing it, together with the transfer belt 106. By being supplied with an electric field of electric charges from the attraction charger 114, the recording material P is electrostatically held and conveyed on the transfer belt 106.

A noncontact-type charger utilizing corona discharge, or a contact-type charger using a charging member, such as a charging roller, a charging brush or a charging blade, is used as the transfer charger 107. Noncontact-type chargers have problems such as, generation of ozone, weakness against variations in the temperature and humidity of atmospheric air because charging is performed via air, resulting in, for example, unstable image formation. On the other hand, contact-type chargers have advantages, such as no generation of ozone, strength against variations in the temperature and humidity of atmospheric air, and the like.

Charges on the recording material P having the toner image transferred thereto are removed by a separation charger 116 at a downstream portion in the conveying direction of the transfer belt 106. The electrostatic attracting force of the recording material P is thereby attenuated, so that the recording material P is separated from an end portion of the transfer belt 106.

Particularly, since in a low-humidity environment, the recording material P is dried and has a high electrical resistivity, the electrostatic attracting force with the transfer belt 106 is large. Hence, the effect of the separation charger 116 is large. Usually, the separation charger 116 removes charges from the recording material P in a state in which the toner image is unfixed. Accordingly, a noncontact-type charger is used as the separation charger 116.

An AC voltage of about Vp−p=10 kV, and a frequency of 500 Hz is used as the output of the separation charger 116. In order to prevent failures in the obtained image, such as dispersion of toner particles, and the like, a positive or negative DC component of about +100 μA is, in some cases, superposed on the AC output.

The separated recording material P is conveyed to the fixing unit 109. The fixing unit 109 includes a fixing roller, a pressing roller, a heat-resistant cleaning member for cleaning these rollers, heaters disposed within the respective rollers, a coating roller for coating a release oil, such as a dimethylsilicone oil or the like, on the fixing roller, a reservoir for the oil, and a thermistor for controlling the fixing temperature by detecting the surface temperature of the pressing roller.

The toner image formed on the recording material P is fixed to provide a copy image, and the recording material P having the fixed toner image is discharged onto a discharged-sheet tray.

Toner particles remaining on the photosensitive drum 105 after the image transfer are cleaned and removed by the cleaner 108, and the photosensitive drum 105 is used for the subsequent latent-image formation.

Toner particles and other foreign matter remaining on the transfer belt 106 and accumulated charges after separating the recording material P are cleaned by being passed between a conductive fur brush 110 and a grounded driving roller 111 facing it. An idler roller 112 provides tension on the transfer belt 106. A conductive web (nonwoven fabric) may be used instead of the conductive fur brush.

The above-described image forming apparatus uses a pair of rollers, i.e., the attraction charger 114 and the roller 115 facing it, as electrostatic attraction means for the recording material P. However, as in the case of the transfer charging means, a noncontact-type charger utilizing corona discharge, or a contact-type charger using a charging member, such as a charging roller, a charging brush or a charging blade, may, of course, also be used as the electrostatic attraction means.

However, when a contact-type charger is used, since tight contact between the recording material P and the transfer belt 106 is not guaranteed, it is necessary to secure tight contact between the recording material P and the transfer belt 106 by separately providing a pressing member.

In order to realize stable electrostatic attraction and conveyance of the recording material P, it is, of course, necessary to perform attraction charging for the entire width of the recording material P (a length of the recording material P in a direction substantially orthogonal to the conveying direction of the recording material P).

Japanese Patent Laid-Open Application (Kokai) No. 2-157779 (1990) discloses that projections and recesses of a carried sheet constituting a transfer drum are corrected by correction means at the upstream side in the direction of rotation of the carried sheet of an attraction corona charger for electrostatically attracting a transfer material onto the carried sheet. There is also disclosed that the conductive roller has the shape of a crown. This structure is adopted for the purpose of providing a uniform contact pressure in the thrust direction by preventing a decrease in the contact pressure at a central portion compared with the contact pressure at both end portions due to deformation of the conductive roller in the thrust direction. There is also disclosed that a pair of rollers for correcting projections and recesses of the carried sheet before electrostatically attracting the transfer material onto the carried sheet are provided, and that at least of one of the pair of rollers may be formed in the shape of a crown, for the above-described reason.

In the image forming apparatus shown in FIG. 7, however, for example, when a recording material left in a high-humidity or low-humidity environment is used, or recording is performed on a second surface of a recording material in duplex printing in which images are formed on both surfaces of the recording material, the image quality is, in some cases, greatly degraded.

This is because the recording material is deformed, and a portion having an inferior contact state with the transfer belt 106 is generated due to degradation in the flatness of the recording material.

For example, paper, serving as a recording material, mounted within a sheet feeding cassette absorbs or discharges water depending on the temperature and humidity of external air. The paper is deformed substantially as a part of a spherical surface in this process.

When such paper is fed onto the transfer belt 106 and passes through the pair of rollers, i.e., the attraction charger 114 and the roller 115 facing it, the paper is squeezed by the pair of rollers and is adjusted with the transfer belt 106 having high flatness. As a result, the deformation of the paper is accumulated as the paper passes, and the paper is, in some cases, held in a state in which a central portion in the thrust direction of a trailing-edge portion of the paper is separated from the transfer belt 106. Since this separated portion produces a gap at the transfer portion, the image on the photosensitive drum 105 cannot be excellently transferred onto the paper, thereby producing a failure in the obtained image.

Similarly, in an image forming apparatus according to the above-described patent application, also, a failure in image transfer, in some cases, occurs because the transfer material is not excellently attracted onto the carried sheet, thereby causing prominent degradation in the image quality. It can be considered that this is for the following reason. Namely, since the carried sheet and the transfer material are not tightly pressed between the conductive roller, serving as an electrostatic attraction member, and the attracting corona charger, the transfer material is not sufficiently attracted onto the carried sheet in a close contact state, when a transfer material left in a high-humidity or low-humidity environment, or a transfer material on one surface of which a toner image has been transferred and fixed in duplex printing is used. It has also become clear that, since there is a considerable distance between a pressing position where the transfer material is pressed against the carried sheet by the pair of rollers and an electrostatically attracting portion where the transfer material is electrostatically attracted onto the carried sheet by the attraction corona charger and the conductive roller, inferior contact between the transfer material and the carried sheet occurs, thereby producing a gap between the transfer material and the carried sheet or crease in the transfer material, resulting in a failure in image transfer.

SUMMARY OF THE INVENTION

It is an object of the present invention to provide an image forming apparatus in which a recording material can be excellently attracted onto a recording-material carrying member without producing a gap between the recording material and the recording-material carrying member.

According to one aspect of the present invention, an attraction member for attracting a recording material onto a recording-material carrying member includes a cylindrical member, a rubber provided on a first region at a central portion of the cylindrical member in the longitudinal direction, and a brush provided on each of second regions adjacent to the first region at both end portions of the cylindrical member in the longitudinal direction.

According to another aspect of the present invention, an image forming apparatus includes a recording-material carrying member for carrying and conveying a recording material, and attraction means for electrostatically attracting the recording material onto the recording-material carrying member. The attraction means includes a first attraction member and a second attraction member, provided at a side of the recording-material carrying member where the recording-material is carried and at an opposite side of the recording-material carrying member, for contacting the recording material and the recording-material carrying member, respectively, during the attraction. The image forming apparatus also includes image forming means for forming an image on the recording material attracted on the recording-material bearing member by the attraction means and conveyed by the recording-material carrying member. When attracting the recording material onto the recording-material carrying member by the attraction means, a pressing force applied from both of the first attraction member and the second attraction member to the recording material is larger at a central portion than at both end portions in a direction substantially orthogonal to a direction of conveying the recording material.

The foregoing and other objects, advantages and features of the present invention will become more apparent from the following detailed description of the preferred embodiments taken in conjunction with the accompanying drawings.

DETAILED DESCRIPTION OF THE PREFERRED EMBODIMENTS

First Embodiment

Figure 2:
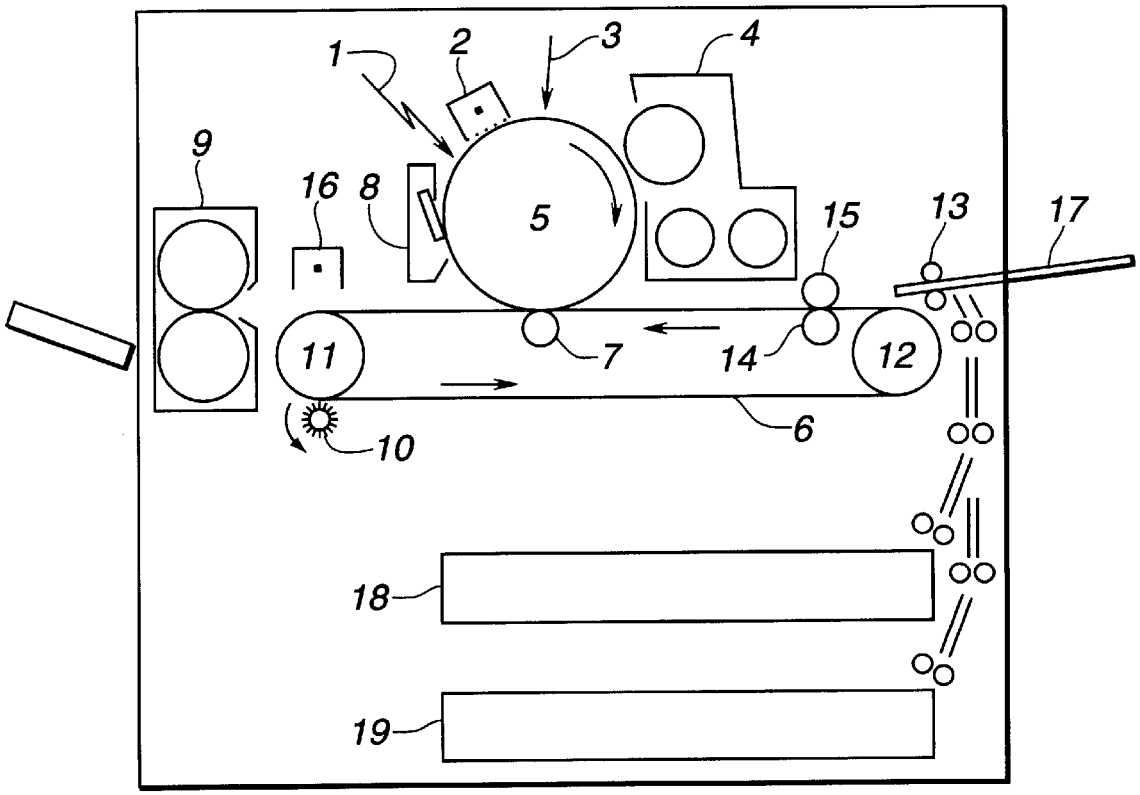
FIG. 2 is a schematic cross-sectional view illustrating an image forming apparatus according to the present invention.

A description will be provided of an image forming apparatus according to the present invention with reference to the drawings. FIG. 2 is a schematic cross-sectional view illustrating the configuration of the image forming apparatus. The schematic configuration and the image forming operation of the apparatus will now be described.

In FIG. 2, within a main body of the image forming apparatus, a photosensitive drum 5, serving as image forming means, is disposed at a central portion. A pre-exposure lamp 1, a primary charger 2, an exposure apparatus 3, a developing unit 4, a transfer charger 7 and a cleaner 8 are sequentially provided around an outer circumference of the photosensitive drum 5.

A transfer belt 6, serving as a recording-material carrying member, is provided near the photosensitive drum 5. A toner image formed on the photosensitive drum 5 is transferred onto a recording material P carried and conveyed on the transfer belt 6.

The toner image on the recording material P is fixed by a fixing unit 9 by means of heat and pressure, and the recording material P having the toner image transferred thereto is discharged to the outside of the apparatus as a recorded image.

In the exposure apparatus 3, a laser beam emitted from a light source (not shown) provided at an upper portion of the main body of the apparatus is converted into a scanning beam by a rotating polygonal mirror. The scanning beam is reflected by a reflecting mirror and is condensed onto the generatrix of the photosensitive drum 5 by an fθ lens to expose the photosensitive drum 5. Thus, a latent image corresponding to an image signal is formed on the photosensitive drum 5.

A predetermined amount of toner is filled in the developing unit 4 from a toner supply device (not shown). The latent image on the photosensitive drum 5 is developed by the toner, to provide a visualized toner image.

Sheets of the recording material P is accommodated within sheet feeding cassettes 18 and 19. A sheet of the recording material P is supplied from one of the cassettes 18 and 19 to the transfer belt 6 via a plurality of conveying rollers and a pair of registration rollers 13, and is further fed to a transfer portion facing the photosensitive drum 5 by being conveyed by the transfer belt 6. Reference numeral 17 represents a manual-insertion sheet feeding tray for performing manual sheet feeding.

The transfer belt 6 is made of a material obtained by dispersing a conductive filler, such as carbon black or the like, in a sheet of a dielectric resin, such as a polycarbonate resin, a polyethylene terephthalate (PET) resin, a polyvinylidene fluoride resin, a polyurethane resin, a polyamide resin, a polyimide resin or the like, in order to reduce the volume resistivity of the insulating resin to about $10^7$–$10^{11}\Omega\cdot$cm, and has an endless shape by superposing and bonding both end portions of the sheet, or the shape of a seamless belt.

When the transfer belt 6 is rotated by a driving roller 11 in cooperation with roller 12 and reaches a constant speed, the recording material P is fed from the pair of registration rollers 13 to the transfer belt 6, and is conveyed to the transfer portion. At the same time, an image write signal is generated, and image formation is performed on the photosensitive drum 5 at a certain timing based on the signal.

By providing an electric field or electric charges from the transfer charger 7 at the transfer portion below the photosensitive drum 5, the toner image formed on the photosensitive drum 5 is transferred onto the recording material P. When the recording material P is fed from the pair of registration rollers 13 onto the transfer belt 6, the recording material P is immediately grasped by an attraction charger 14 and a roller 15 facing it, both serving as charging pressing means, together with the transfer belt 6. By being supplied with an electric field of electric charges from the attraction charger 14, the recording material P is electrostatically held and conveyed on the transfer belt 6.

In the first embodiment, from the viewpoint of providing stable tight contact between the recording material P and the transfer belt 6 simultaneously with charging, the attraction charger 14 has the shape of a roller. Similarly, the transfer charger 7 has the shape of a roller.

Charges on the recording material P having the toner image transferred thereto are removed by a separation charger 16 at a downstream portion in the conveying direction of the transfer belt 6. The electrostatic attracting force of the recording material P is thereby attenuated, so that the recording material P is separated from an end portion of the transfer belt 6.

Particularly, since in a low-humidity environment, the recording material P is dried and has a high electrical resistivity, the electrostatic attracting force with the transfer belt 6 is large. Hence, the effect of the separation charger 16 is large. Usually, the separation charger 16 removes charges from the recording material P in a state in which the toner image is unfixed. Accordingly, a noncontact-type charger is used as the separation charger 16.

An AC voltage of about Vp−p =10 kV, and a frequency of 500 Hz is used as the output of the separation charger 16. In order to prevent failures in the obtained image, such as dispersion of toner particles, and the like, a positive or negative DC component of about +100 $\mu$A is, in some cases, superposed on the AC output.

The separated recording material P is conveyed to the fixing unit 9. The fixing unit 9 includes a fixing roller, a pressing roller, a heat-resistant cleaning member for cleaning these rollers, heaters disposed within the respective rollers, a coating roller for coating a release oil, such as a dimethylsilicone oil or the like, on the fixing roller, a reservoir for the oil, and a thermistor for controlling the fixing temperature by detecting the surface temperature of the pressing roller.

The toner image formed on the recording material P is fixed to provide a copy image, and the recording material P having the fixed toner image is discharged onto a discharged-sheet tray.

This image forming apparatus is configured so as to be able to form images on both surfaces of the recording material P. In this case, a toner image is transferred onto a first surface of the recording material P. After fixing the toner image on the first surface, the recording material P is passed through a reversal path (not shown), and is fed to the transfer belt 6. Thereafter, a toner image is transferred onto a second surface of the recording material P, and the transferred image is fixed.

Toner particles remaining on the photosensitive drum 5 after the image transfer are cleaned and removed by the cleaner 8, and the photosensitive drum 5 is used for the subsequent latent-image formation.

Toner particles and other foreign matter remaining on the transfer belt 6 and accumulated charges after separating the recording material P are cleaned by causing a conductive fur brush 10 provided at a side where the recording material P is carried to contact the transfer belt 6. A conductive web (nonwoven fabric) may be used instead of the conductive fur brush. A driving roller 11 is grounded as an electrode facing the conductive fur brush 10.

Figure 1A:
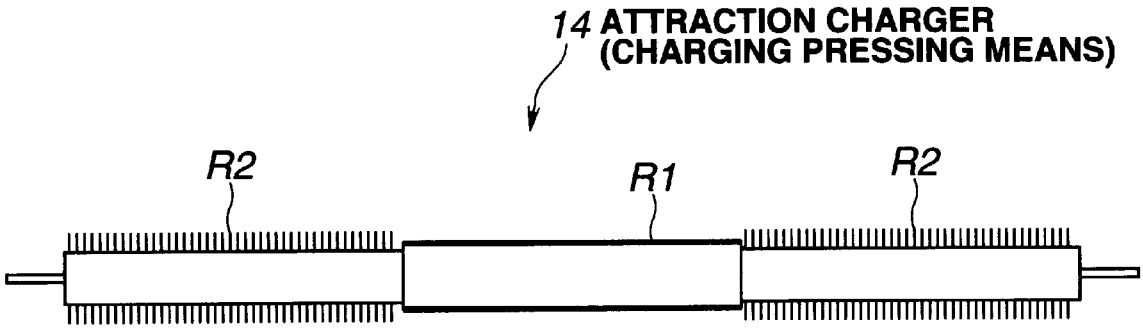
FIGS. 1A and 1B are schematic diagrams illustrating an attraction charger according to a first embodiment of the present invention.
Figure 1B:
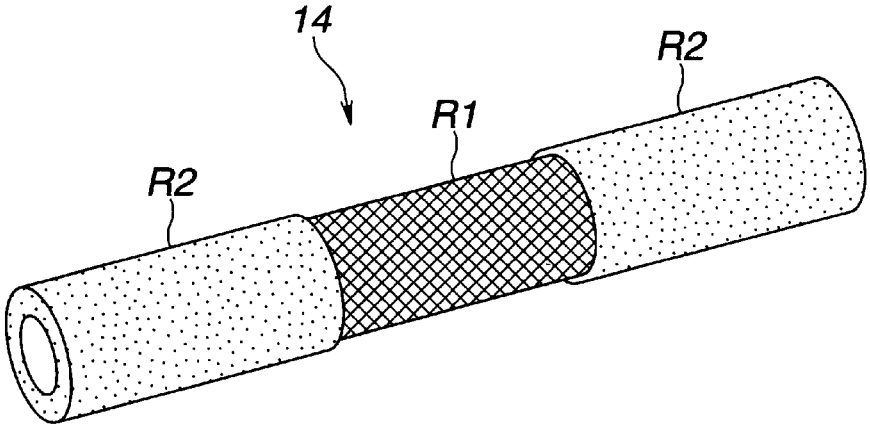

In the image forming apparatus operating in the above-described manner, as shown in FIGS. 1A and 1B, the attracting charger 14 is covered with a rigid conductive rubber in a region R1 150 mm wide at a central portion in the longitudinal direction, and is planted with a conductive fur brush in each of regions R2 80 mm wide at each of both end portions.

More specifically, the central portion is covered with a conductive EPDM (ethylene propylene diene monomer) rubber material (having a hardness of 50 degrees, and a volume resistivity of $10^8\Omega\cdot$cm) 1.0 mm thick. The end portions are planted with conductive rayon fibers (having a volume resistivity of $10^8\Omega\cdot$cm, and a density of 50,000/inch$^2$) 3.0 mm long (including the ground fabric). The amount of penetration of the fur brush at the end portions in a state in which the transfer belt 6 contacts the central conductive rubber layer is estimated to be 1.0 mm.

Figure 3:
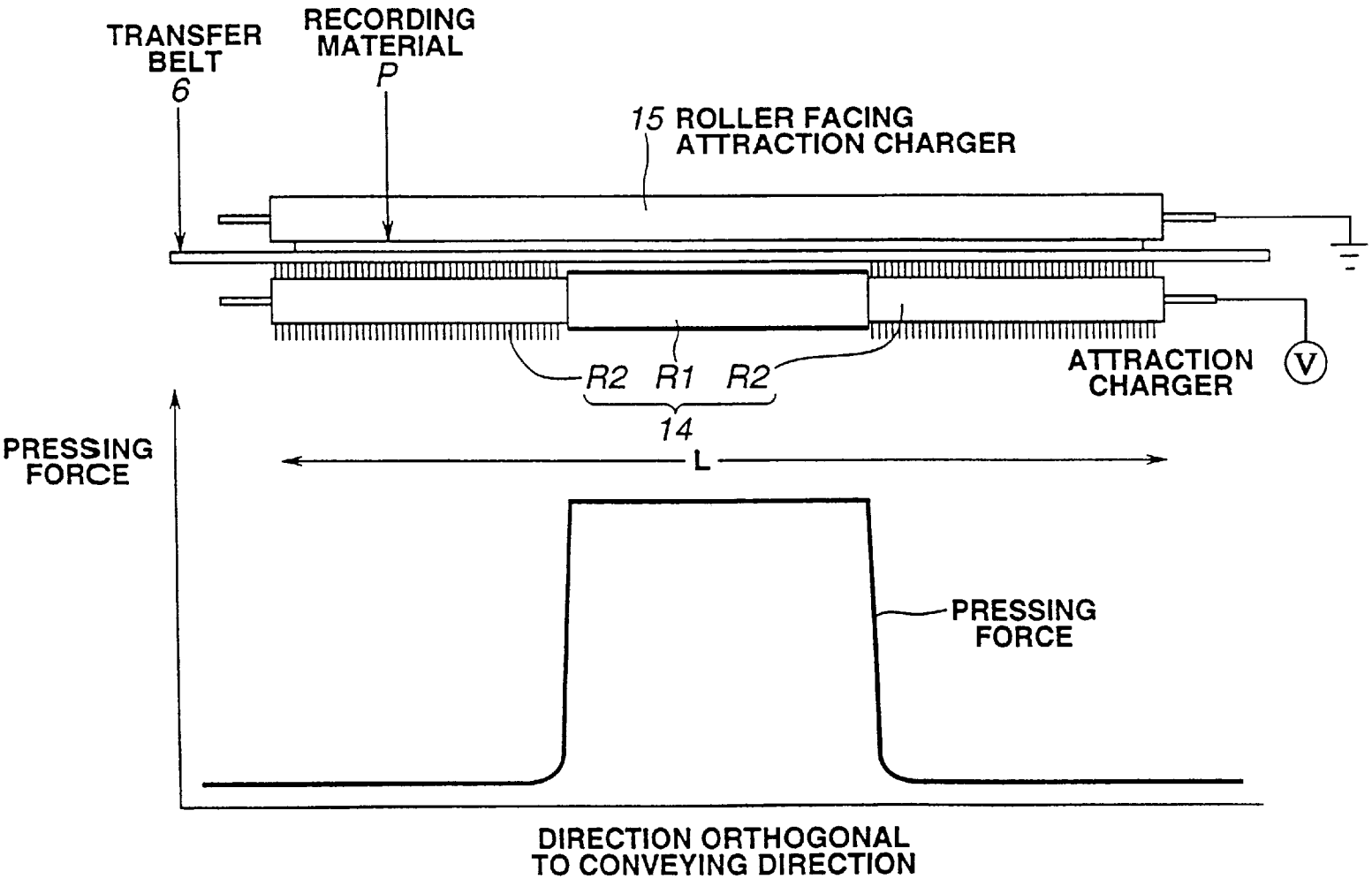
FIG. 3 is a diagram illustrating the distribution of a pressing force by the attraction charger shown in FIGS. 1A and 1B.

As shown in FIG. 3, the lengths of the attraction charger 14 and the roller 15 facing it in the thrust direction are larger than the length of the recording material P in the thrust direction. Namely, the length of the recording material P in the thrust direction is shorter than the length of a region L where the attraction charger 14 and the roller 15 facing it contact the transfer belt 6 in an overlapped state. According to this configuration, unevenness in attracting charges supplied to the recording material P and the region of the transfer belt 6 where the recording material P is attracted does not occur in the thrust direction. Hence, generation of unevenness in image transfer in the subsequent transfer process can be prevented.

By using the attraction charger 14 having the above-described configuration, and grasping the transfer belt 6 together with the roller 15 (grounded) whose outer diameter is substantially constant in the longitudinal direction, while the grasping force is large at the central portion made of the conductive rubber due to the pressure of the central portion, a grasping force which is negligibly small compared with the tension of the transfer belt 6 is applied to the recording material P and the transfer belt 6 at the end portions made of the conductive fur brushes because the pressure of the fibers of the fur brushes is weak (see FIG. 3).

The attraction charger 14 is manufactured in the following manner.

(1) First, portions corresponding to the regions R2 at the end portions of a rigid cylindrical member made of SUS 416 having an outer diameter of 13.7 mm are shaved to a diameter of 12 mm using a lathe.

(2) A conductive rubber tube is subjected to press fitting in the region R1 at the central portion of the cylindrical member.

(3) A conductive cloth having a conductive fur brush planted thereon is spirally wound around each of the portions corresponding to the region R2 at the end portions of the cylindrical member. At that time, the conductive cloth is bonded using a conductive pressure sensitive adhesive double coated tape.

The manufacture of the attraction charger 14 is completed after passing through the above-described processes (1)–(3).

Figure 4A:
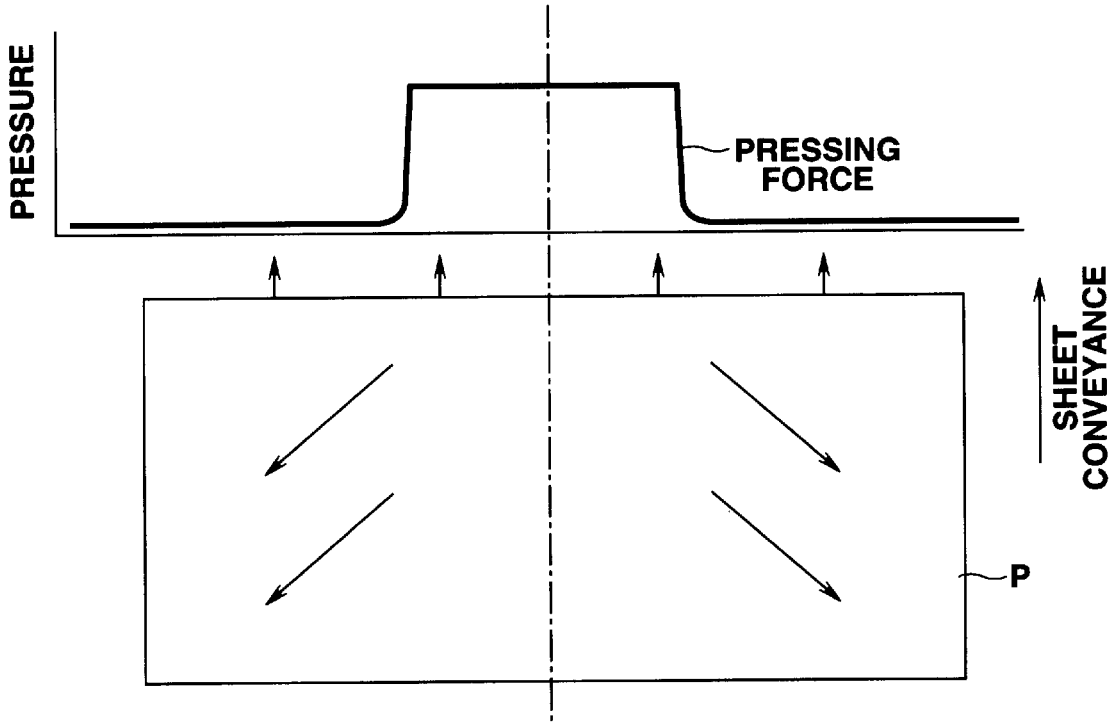
FIGS. 4A and 4B are diagrams illustrating the action of the attraction charger shown in FIGS. 1A and 1B on a recording material.

According to the distribution of the pressing force shown in FIG. 3, even if a recording material P left for a long time or deformed, for example, by the presence of a printed image on the back of the sheet, resulting in prominent degradation in flatness, is used, by passing the recording material P through the attracting portion, as shown in FIG. 4A, the deformation is averaged from the center line parallel to the conveying direction of the recording material P toward the outside along the transfer belt 6.

Accordingly, separation of a portion of the recording material P does not occur, the flatness of the recording material P is maintained, and a high-quality image is formed at the transfer portion.

Figure 4B:
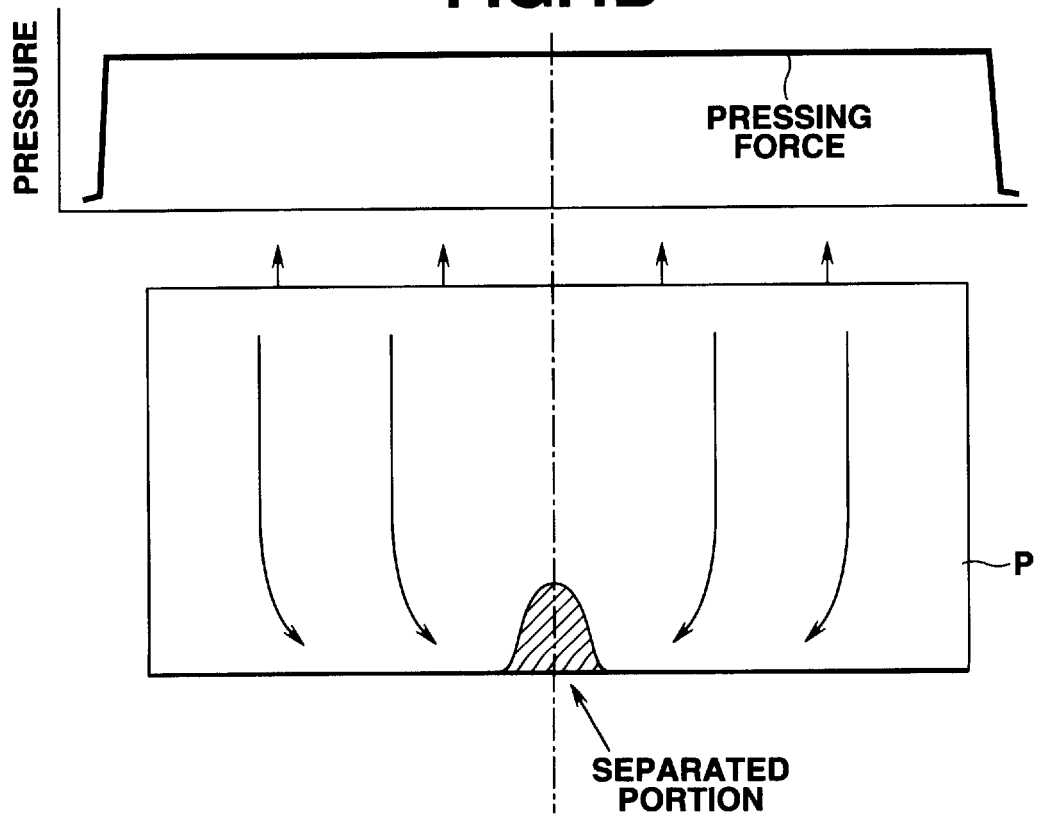

When a conventional uniform conductive-rubber roller having no pressure distribution is used, then, as shown in FIG. 4B, the distortion of the deformed recording material P is accumulated at the trailing edge of the recording material P, and a distortion which cannot be dissolved remains at the center of the trailing-edge portion of the recording material P. Accordingly, the recording material P does not entirely contact the transfer belt 6, thereby producing a separated portion. In such a case, normal image transfer is not performed at the separated portion at the downstream side of the transfer portion, thereby producing, in some cases, a failure in the obtained image.

Although in the first embodiment, the attraction charger 14 has been illustrated, the present invention may also be applied to a configuration in which attracting charging is not performed when the recording material P is mounted on the transfer belt 6, and the recording material P is first attracted by the transfer charger after being conveyed to the transfer portion.

Second Embodiment

Figure 5:
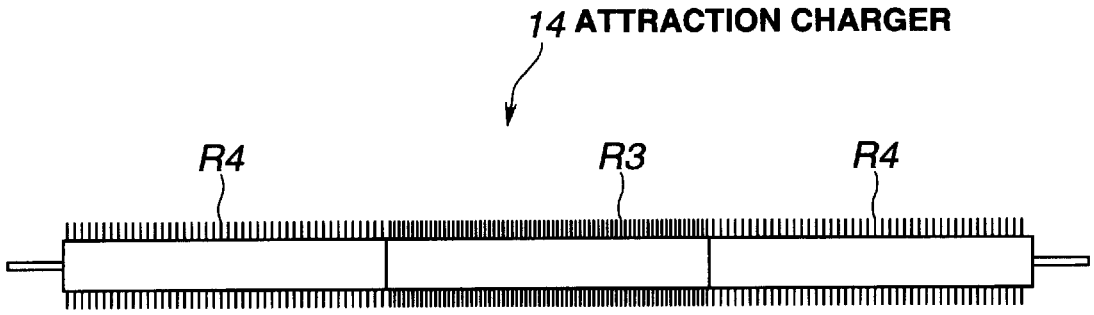
FIG. 5 is a schematic diagram illustrating an attraction charger according to a second embodiment of the present invention.

In an image forming apparatus operating in the same manner as in the first embodiment, an attraction charger 14 according to a second embodiment of the present invention has, as shown in FIG. 5, a region R3 150 mm wide at a central portion in the longitudinal direction, and a region R4 80 mm wide at each of both end portions, and different types of conductive fur brushes are planted in the regions R3 and R4. A roller 15 facing the attraction charger 14 is the same as in the first embodiment.

More specifically, conductive rayon fibers 3.0 mm long (including the ground fabric) are used for both the central portion and the end portions. However, the conductive rayon fibers at the central portion have a volume resistivity of $10^7\Omega\cdot$cm and a density of 200,000/inch$^2$, and the conductive rayon fibers at the end portions have a volume resistivity of $10^6\Omega\cdot$cm and a density of 20,000/inch$^2$.

Since the density of the conductive rayon fibers is higher at the central portion, the grasping force of the nip of the attracting portion in the longitudinal direction is higher at the central portion and lower at the end portions, as in the first embodiment.

In the configuration shown in FIG. 5, also, since the grasping force is higher at the central portion than at the end portions as in the case of the attraction charger 14 in the first embodiment shown in FIG. 4A for dissolving the deformation of the recording material P, the effect of averaging the deformation of the recording material P from the center line parallel to the conveying direction of the recording material P toward the outside along the transfer belt 6 is obtained by passing the recording material P through the attracting portion. Hence, unevenness in attracting charging, and a separated portion in the recording material P are not generated, and the flatness of the recording material P is maintained, resulting in formation of a high-quality image at the transfer portion.

Third Embodiment

Figure 6:
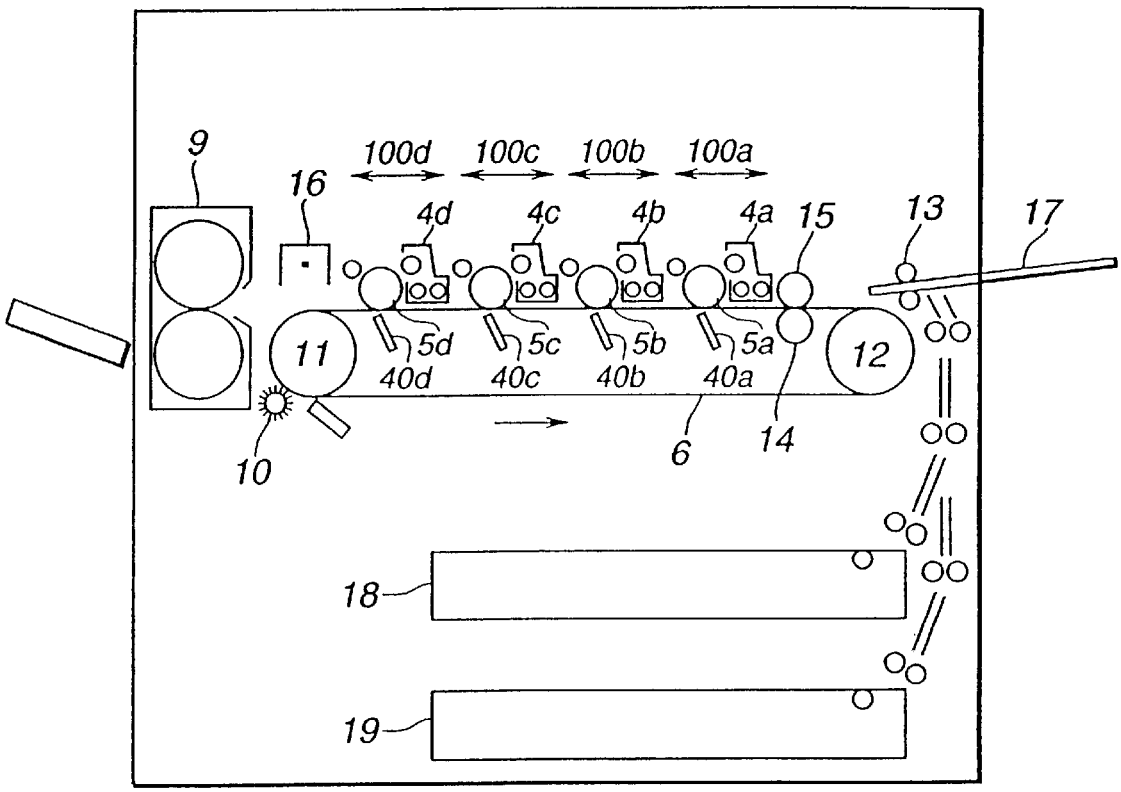
FIG. 6 is a schematic diagram illustrating an image forming apparatus according to a third embodiment of the present invention.
Figure 7:
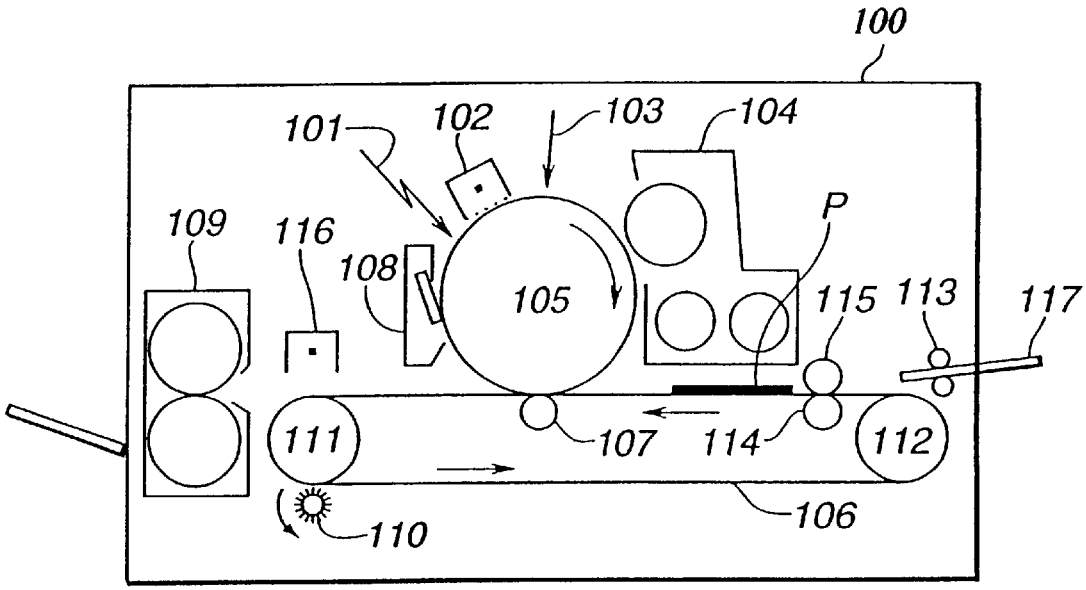
FIG.7 PRIOR ART
FIG. 7 is a schematic diagram illustrating a conventional image forming apparatus.

The attraction charger 14 and the roller 15 facing it shown in the first and second embodiments may also be applied to an image forming apparatus shown in FIG. 6. In FIG. 6, the same components having the same functions as those shown in FIG. 2 are indicated by the same reference numerals, and further description thereof will be omitted.

The image forming process in the image forming apparatus shown in FIG. 6 will now be briefly described. In FIG. 6, image forming stations 100*a* (a yellow-toner image forming unit), 100*b* (a magenta-toner image forming unit), 100*c* (a cyan-toner image forming unit) and 100*d* (a black-toner image forming unit) are disposed along the moving direction of a transfer belt 6. Toner images having respective colors formed in the corresponding image forming stations are electrostatically transferred sequentially onto a recording material P attracted on the transfer belt 6 by the attraction charger 14 and the roller 15 facing it in a superposed state by transfer chargers (blades) 40*a*–40*d*. Then, the recording material P is separated from the transfer belt 6. A toner image obtained by superposing the toner images of the respective colors is fixed on the recording material P by a fixing device 9, and the recording material P having the toner image fixed thereon is discharged to the outside of the apparatus.

In this image forming apparatus, in some cases, image e formation is not performed by some of the image forming units depending on an input image signal. For example, when forming a black-and-white image, it is possible to perform 6 image formation by only the black-toner image forming unit 100*d*, without performing image formation by the yellow-toner, magenta-toner and cyan-toner image forming units 100*a*, 100*b* and 100*c*, respectively. At that time, in order to prevent a jam of the recording material P, photosensitive drums 5*a*–5*c* are maintained to rotate.

In such a case, in the image forming units 100*a*, 100*b* and 100*c*, in order to prevent generation of physical damages and an electric memory effect, and a degradation in the charging performance of the photosensitive drums 5*a*–5*c*, currents passing through the transfer chargers 40*a*–40*c* are made smaller than during image formation or made zero, or the pressing forces of the transfer chargers 40*a*–40*c* against the transfer belt 6 are reduced.

Particularly, in an image forming apparatus in which a photosensitive drum 5 is subjected to contact constant-voltage charging by a primary charger 2, it is known that as the difference between the potential before passing through the contact charging portion and the charging potential of the photosensitive drum 5 is larger, the amount of abrasion of the surface layer of the photosensitive drum 5 is larger.

Accordingly, in a mode of forming a black-and-white image in which image formation is not performed by the image forming stations 100*a*, 100*b* and 100*c*, by electrostatically attracting the recording material P onto the transfer belt 6 by the attraction charger 14 and the roller 15 facing it, the recording material P can be assuredly conveyed to the image forming station 100*d*, and deviation in the position where a black toner image is transferred onto the recording material P can be prevented.

The present invention may also be applied to the above-described image forming apparatus shown in FIG. 6, and it is possible to prevent generation of crease in the recording material P and generation of unevenness in attraction charging. Furthermore, since the recording material P can be electrostatically attracted excellently onto the transfer belt 6 at a predetermined timing, it is possible to prevent deviation in the position of the toner image transferred onto the recording material P.

In the foregoing embodiments, an attracting bias voltage is applied to the attraction charger 14 and the roller 15 facing the attraction charger 14 is grounded. However, the present invention is not limited to this configuration. For example, the attraction charger 14 and the roller 15 facing it may be provided at positions opposite to the above-described positions. In another approach, an appropriate voltage may be applied to the roller 15 facing the attraction charger 14. In this case, the attraction charger 14 may be grounded.

The individual components shown in outline in the drawings are all well known in the attraction member and image forming apparatus arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An attraction member for attracting a recording material onto a recording-material carrying member, said attraction member comprising:

a cylindrical member;

a rubber provided on a first region at a central portion of said cylindrical member in the longitudinal direction; and a brush provided on each of second regions adjacent to the first region at both end portions of said cylindrical member in the longitudinal direction.

2. An attraction member according to claim 1, wherein the first region is shorter than a length of the recording material in a direction substantially orthogonal to a direction of conveying the recording material.

3. An attraction member according to claim 1 or 2, wherein, when attracting the recording material onto the recording-material carrying member, a voltage is applied to said attraction member.

4. An attraction member according to claim 3, wherein said rubber comprises a conductive rubber.

5. An attraction member according to claim 4, wherein said brush comprises a conductive brush.

6. An attraction member according to claim 1, wherein said attraction means electrostatically attracts the recording material onto said recording-material carrying member.

7. An image forming apparatus comprising:

a recording-material carrying member for carrying and conveying a recording material;

attraction means for attracting the recording material onto said recording-material carrying member, said attraction means comprising a first attraction member and a second attraction member, provided at a side of said recording-material carrying member where the recording material is carried and at an opposite side of said recording-material carrying member so as to face each other, for contacting the recording material and said recording-material carrying member, respectively, during the attraction; and image forming means for forming an image on the recording material attracted on said recording-material carrying member by said attraction means and conveyed by said recording-material carrying member, wherein said first attraction member comprises a rubber in a first region at a central portion of a cylinder member in a direction substantially orthogonal to a direction of conveying the recording material, and a brush on each of second regions adjacent to the first region at both end portions of said cylindrical member in the direction substantially orthogonal to the direction of conveying the recording material, and wherein, when attracting the recording material onto said recording-material carrying member by said attraction means, a pressing force applied from both of said first attraction member and said second attraction member to the recording material is larger at the first region than at the second regions.

8. An image forming apparatus according to claim 7, wherein, when attracting the recording material onto said recording-material carrying member by said attraction means, the entire recording material is pressed by both of said first attraction member and said second attraction member in the direction substantially orthogonal to the direction of conveying the recording material.

9. An image forming apparatus according to claim 7, wherein, when attracting the recording material onto said recording-material carrying member by said attraction means, a voltage is applied to at least one of said first attraction member and said second attraction member.

10. An image forming apparatus according to claim 7, wherein, when attracting the recording material onto said recording-material carrying member by said attraction means, said first attraction member is grounded, and a voltage is applied to said second attraction member.

11. An image forming apparatus according to claim 7, wherein said image forming means comprises an image bearing member for bearing a toner image, and wherein the toner image on said image bearing member is electrostatically transferred onto the recording material carried on said recording-material carrying member.

12. An image forming apparatus according to claim 7, wherein said image forming means comprises a plurality of image bearing members for bearing corresponding images having a plurality of colors, and wherein the images of the plurality of colors on the plurality of image bearing members are electrostatically transferred sequentially in a superposed state on the recording material carried on said recording-material carrying member at respective transfer positions.

13. An image forming apparatus according to claim 12, wherein it is possible to select between a first mode of forming the images of the plurality of colors on the recording material carried on said recording-material carrying member at the respective transfer positions using said plurality of image bearing members, and a second mode of forming an image on the recording material carried on said recording-material carrying member at a predetermined transfer position using a predetermined image bearing member from among said plurality of image bearing members.

14. An image forming apparatus according to claim 13, wherein the predetermined image bearing member is provided at a most downstream portion in a direction of conveying the recording material by said recording-material carrying member.

15. An image forming apparatus according to claim 14, wherein, when said second mode is selected, an electric field is formed at the predetermined transfer position, and an electric field is not formed at a transfer position at a portion upstream from the predetermined transfer position in the direction of conveying the recording material by said recording-material carrying member.

16. An image forming apparatus according to claim 7, wherein, after forming an image on a first surface of the recording material carried on said recording-material carrying member, said image forming means can form an image on a second surface opposite to the first surface of the recording material carried on said recording-material carrying member.

17. An image forming apparatus according to claim 7, wherein said recording-material carrying member comprises a dielectric material.

18. An image forming apparatus according to claim 7, wherein said rubber comprises a conductive rubber.

19. An image forming apparatus according to claim 18, wherein said brush comprises a conductive brush.

20. An image forming apparatus according to claim 7, wherein said second attraction member comprises a cylindrical member, and wherein a diameter of a region of said second attraction member pressing the recording material is substantially constant in the longitudinal direction of said second attraction member.

21. An image forming apparatus according to claim 7, wherein the first region is shorter than a length of the recording material in the direction orthogonal to a direction of conveying the recording material.

22. An image forming apparatus according to claim 7, wherein said attraction means electrostatically attracts the recording material onto said recording-material carrying member.

23. An image forming apparatus comprising:

a recording-material carrying member for carrying and conveying a recording material;

attraction means for attracting the recording material onto said recording-material carrying member, said attraction means comprising a first attraction member and a second attraction member, provided at a side of said recording-material carrying member where the recording material is carried and at an opposite side of said recording-material carrying member so as to face each other, for contacting the recording material and said recording-material carrying member, respectively, during the attraction; and image forming means for forming an image on the recording material attracted on said recording-material carrying member by said attraction means and conveyed by said recording-material carrying member, wherein said second attraction member comprises a rubber section in a first region at a central portion of a cylindrical member in a direction substantially orthogonal to a direction of conveying the recording material, and a brush on each of second regions adjacent to the first region at both end portions of said cylindrical member in the direction substantially orthogonal to the direction of conveying the recording material, and wherein when attracting the recording material onto said recording-material carrying member by said attraction means, a pressing force applied from both of said attraction member and said second attraction member to the recording material is larger at the first region than at the second regions.

24. An image forming apparatus according to claim 23, wherein, when attracting the recording material onto said recording-material carrying member by said attraction means, the entire recording material is pressed by both of said first attraction member and said second attraction member in the direction substantially orthogonal to the direction of conveying the recording material.

25. An image forming apparatus according to claim 23, wherein when attracting the recording material onto said recording-material carrying member by said attraction means, a voltage is applied to at least one of said first attraction member and said second attraction member.

26. An image forming apparatus according to claim 23, wherein, when attracting the recording material onto said recording-material carrying member by said attraction means, said first attraction member is grounded, and a voltage is applied to said second attraction member.

27. An image forming apparatus according to claim 23, wherein said image forming means comprises an image bearing member for bearing a toner image, and wherein the toner image on said image bearing member is electrostatically transferred onto the recording material carried on said recording-material carrying member.

28. An image forming apparatus according to claim 23, wherein said image forming means comprises a plurality of image bearing members for bearing corresponding images having a plurality of colors, and wherein the images of the plurality of colors on the plurality of image bearing members are electrostatically transferred sequentially in a superposed state on the recording material carried on said recording-material carrying member at respective transfer positions.

29. An image forming apparatus according to claim 28, wherein it is possible to select between a first mode of forming the images of the plurality of colors on the recording material carried on said recording-material carrying member at the respective transfer positions using said plurality of image bearing members, and a second mode of forming an image on the recording material carried on said recording-material carrying member at a predetermined transfer position using a predetermined image bearing member from among said plurality of image bearing members.

30. An image forming apparatus according to claim 29, wherein the predetermined image bearing member is provided at a most downstream portion in a direction of conveying the recoding material by said recording-material carrying members.

31. An image forming apparatus according to claim 30, wherein, when said second mode is selected, an electric field is formed at the predetermined transfer position, and an electric field is not formed at a transfer position at a portion upstream from the predetermined transfer position in the direction of conveying the recording material by said recording-material carrying member.

32. An image forming apparatus according to claim 23, wherein, after forming an image on a first surface of the recording material carried on said recording-material carrying member, said image forming means can form an image on a second surface opposite to the first surface of the recording material carried on said recording-material carrying member.

33. An image forming apparatus according to claim 23, wherein said recording-material carrying member comprises a dielectric material.

34. An image forming apparatus according to claim 23, wherein said rubber section comprises a conductive rubber.

35. An image forming apparatus according to claim 34, wherein said brush comprises a conductive brush.

36. An image forming apparatus according to claim 23, wherein said first attraction member comprises a cylindrical member, and wherein a diameter of a region of said first attraction member pressing the recording material is substantially constant in the longitudinal direction of said first attraction member.

37. An image forming apparatus according to claim 23, wherein the first region is shorter than a length of the recording material in a direction orthogonal to a direction of conveying the recording material.

38. An image forming apparatus according to claim 23, wherein said attraction means electrostatically attracts the recording material onto said recording-material carrying member.

* * * * *

UNITED STATES PATENT AND TRADEMARK OFFICE

CERTIFICATE OF CORRECTION

PATENT NO. : 6,178,307 B1
DATED : January 23, 2001
INVENTOR(S) : Yoichi Kimura

It is certified that error appears in the above-identified patent and that said Letters Patent is hereby corrected as shown below:

Column 9,
Line 52, "e" should be deleted; and
Line 56, "perform 6" should read -- perform --.

Column 14,
Line 14, "recoding" should read -- recording --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*